United States Patent [19]

Ōya et al.

[11] 4,192,846

[45] Mar. 11, 1980

[54] EXHAUST GAS PURIFICATION SYSTEM FOR INTERNAL COMBUSTION ENGINES

[75] Inventors: Hiroo Ōya; Masakazu Tatejima, both of Ohta, Japan

[73] Assignee: Fuji Jukogyo Kabushiki Kaisha, Tokyo, Japan

[21] Appl. No.: 859,165

[22] Filed: Dec. 9, 1977

[30] Foreign Application Priority Data

Dec. 13, 1976 [JP] Japan ..... 51-149622

[51] Int. Cl.[2] ..... F01N 3/10

[52] U.S. Cl. ..... 422/168; 60/282; 60/293

[58] Field of Search ..... 23/277 C; 60/282, 293; 422/168

[56] References Cited

U.S. PATENT DOCUMENTS

| | | | |
|---|---|---|---|
| 3,990,233 | 11/1976 | Will et al. | 60/282 |
| 3,990,856 | 11/1976 | Suzuki | 60/282 X |
| 4,037,407 | 7/1977 | Mizuno et al. | 60/293 X |
| 4,069,666 | 1/1978 | Nakamura | 60/293 X |

*Primary Examiner*—R. E. Serwin
*Assistant Examiner*—Roger F. Phillips
*Attorney, Agent, or Firm*—Martin A. Farber

[57] ABSTRACT

An exhaust gas purification system for internal combustion engine having a thermal reactor interposed in the exhaust passage. The thermal reactor comprises a heat insulated inner shell for defining a reaction chamber therein and a core shell provided in the core shell spaced therefrom for providing a space between the both shells. A pair of exhaust pipes communicating with the exhaust valves of the engine are inserted into the core shell through an opening of the core shell so as to form a confluence and constant swirling of the exhaust gases in the core shell to provide a high temperature zone in the center of the swirling. The opening of the core shell is narrowed for preventing high temperature zone from moving out of the reaction chamber.

8 Claims, 5 Drawing Figures

FIG. 1
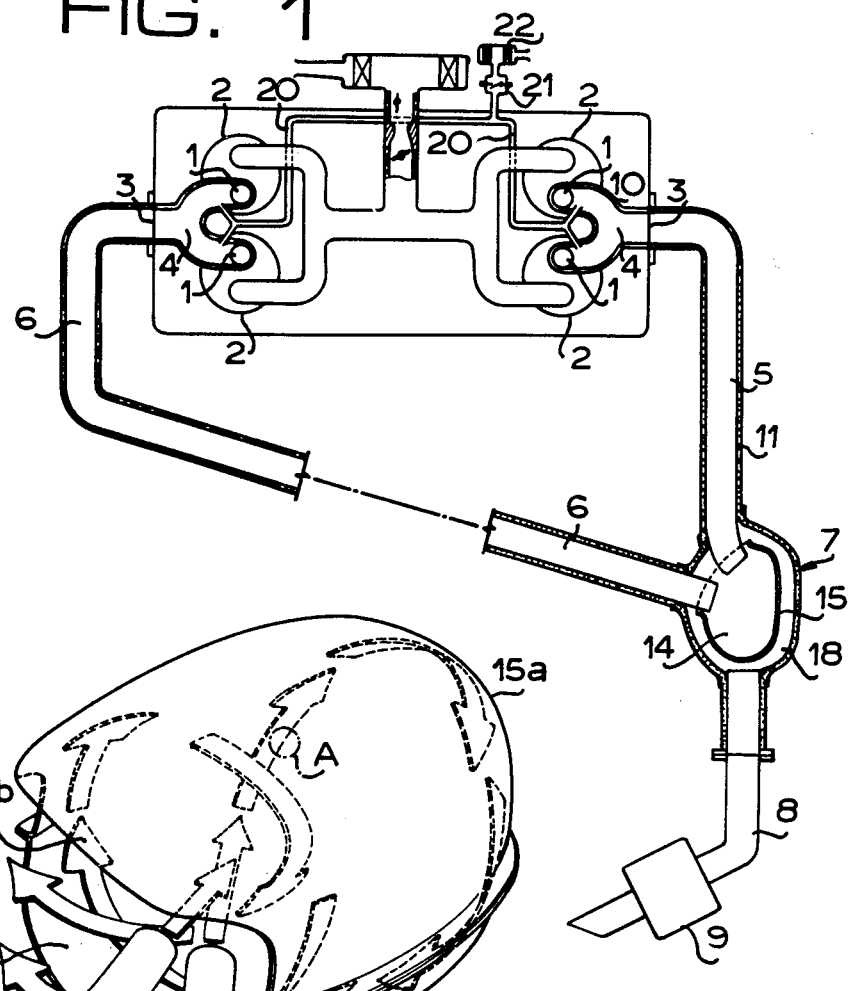
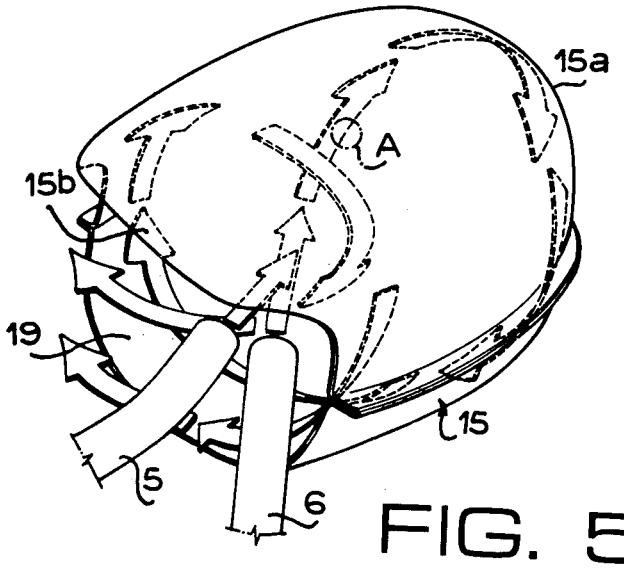
FIG. 5

EXHAUST GAS PURIFICATION SYSTEM FOR INTERNAL COMBUSTION ENGINES

The present invention relates to an exhaust gas purification system for internal combustion engines, and more particularly to a thermal reactor which is provided in the middle of an exhaust passage for oxidizing noxious compounds in exhaust gases such as HC and CO.

To increase reactivity of the thermal reactor it is necessary to construct the thermal reactor to have long residence time of the exhaust gases for a sufficient diffusion and mixture of the gases. Further, it is necessary that the thermal reactor has a continuous reactivity under various operative conditions of the engine. To meet these requirements, heretofore a large thermal reactor with a large volume of the reaction chamber has been used.

Therefore, the object of the present invention is to provide a thermal reactor which has a small volume and is capable of carrying out effective oxidation of the noxious compounds.

The present invention, according to the above object, is characterized in that the thermal reactor has an outer shell and an inner shell to form a reaction chamber and is insulated by heat insulation provided in the space between the outer shell and the inner shell and a core shell is provided in the reaction chamber spaced from the inner shell. A pair of first exhaust pipes communicating with the exhaust ports of the engine are inserted into the reaction chamber and are further inserted into the core shell passing through an opening of the core shell, and a second exhaust pipe communicates with the reaction chamber at the opposite side of the opening of the core shell.

Open ends of the first exhaust pipes are so arranged that the flows from both pipes meet each other to form a confluence and the axis of each pipe makes a proper angle to the inner wall of the core shell so as to cause a swirling of the confluent gases.

The confluent gases collide and mix to enhance the oxidation; this is particularly remarkable in the case of introducing secondary air by a pulsation effect of the exhaust gases.

Figure 4:
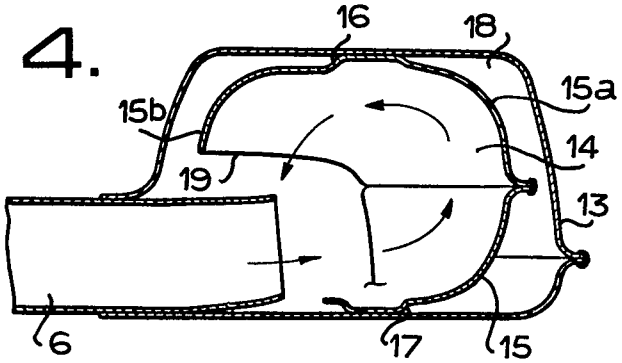
Figure 2:
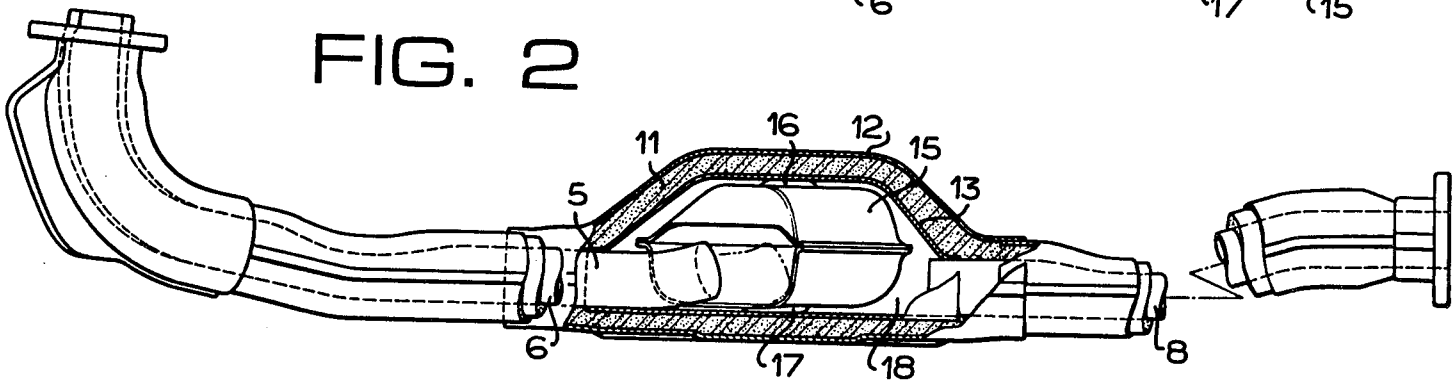
Figure 3:
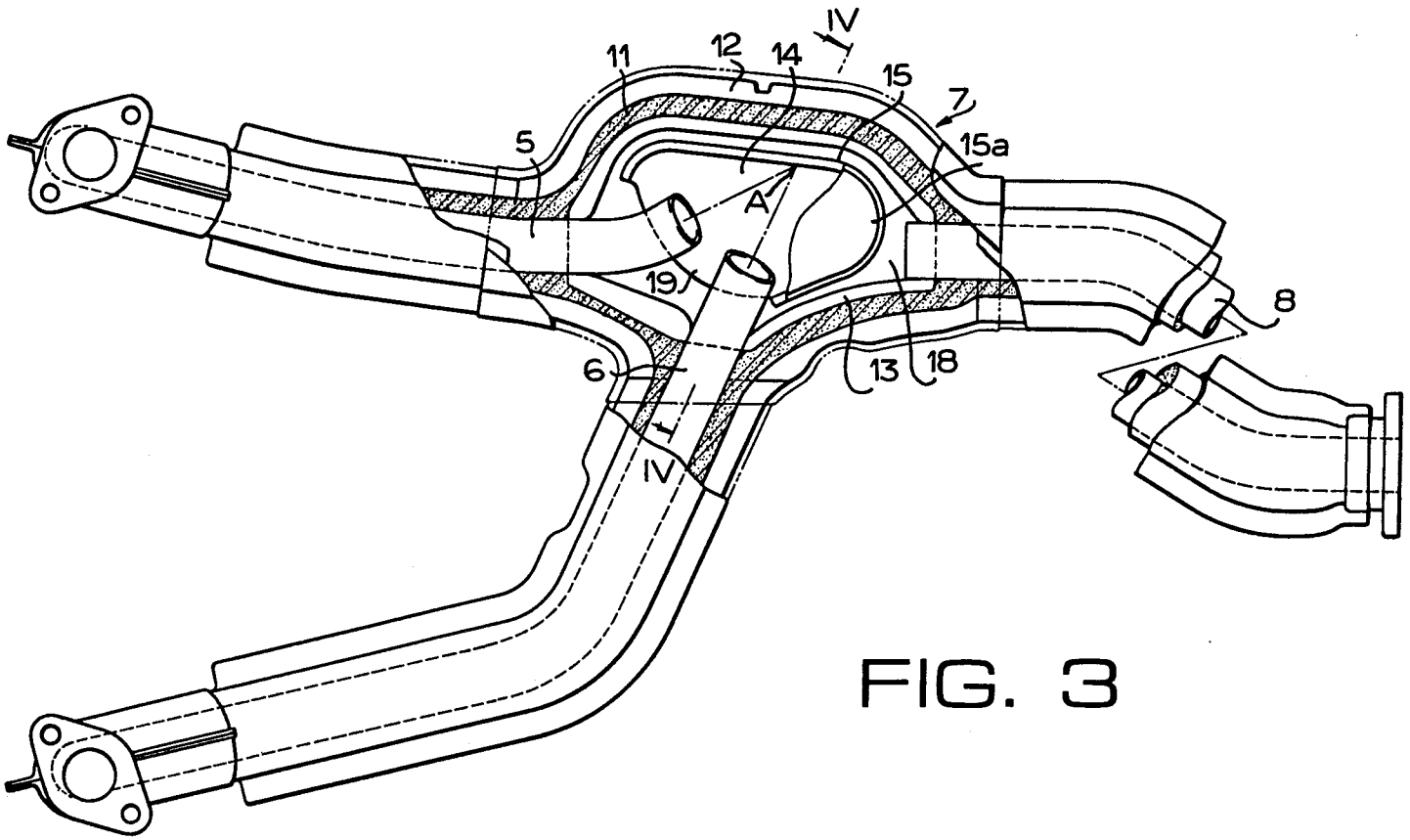

An embodiment of the present invention will be hereinafter described with reference to the accompanying drawings, in which:

FIG. 1 is a schematic plan view showing an embodiment of the present invention, in which the engine cylinder block is developed, FIG. 2 is an enlarged longitudinal section thereof, FIG. 3 is a partially cutaway plan view thereof, FIG. 4 is a sectional view taken on line IV—IV of FIG. 3, and FIG. 5 is a perspective view showing the swirling of the gas flow in a core shell.

As shown in FIG. 1, a system of this invention is employed in a four-cylinder engine of an opposed-cylinder-type in which the exhaust valves 1 of a pair of cylinders 2 are joined to a common outlet 3 by a siamese port passage 4 which communicates with an exhaust pipe 5. The exhaust valves of another pair of cylinders similarly communicate with an exhaust pipe 6. The exhaust pipes 5 and 6 communicate with a thermal reactor 7, and further communicate with an exhaust pipe 8 and further with a silencer 9. The exhaust passage from the exhaust valve to the thermal reactor 7 has a constant cross section without an expanded or reduced portion, whereby the speed of the exhaust gas flow may not be decreased. A liner 10 is provided on the inner wall of each passage 4 for heat insulation and a heat insulation material 11 is provided for covering the exhaust system. The thermal reactor 7, as shown in FIGS. 2 to 4 comprises an outer shell 12 covering the heat insulation material 11 and an inner shell 13 for forming a reaction chamber 14 and a core shell 15 which is supported by an upper projection 16 and a lower projection 17 formed on the outer wall of the core shell on the line vertically extending through the center of gravity of the core shell to provide a space 18 between the inner shell 13 and the core shell 15. The reaction chamber 14 formed in the core shell 15 has an expanded upper portion and a spherical back side 15*a*.

The core shell 15 comprises an egg-shaped body portion and a spherical back side 15*a*. Opposite to the back side 15*a* of the core shell 15, at a front end of the body portion there is provided an opening 19, through which the exhaust pipes 5 and 6 are inserted into the core shell without contacting the core shell. Thus the opening 19 is defined by the outside of the exhaust pipes 5 and 6 and the periphery of the opening of the core shell to form an outlet for the gases in the core shell. The exhaust pipes 5 and 6 are so disposed that both axes thereof are cross or, as shown in FIG. 3, extended to reach the inner wall of the reaction chamber at a point A so as to form a confluence of gas flows. Further the exhaust pipes are arranged such that the confluence of the gas flow reflects at the point A to the back of the reaction chamber in the core shell to provide a swirling of the exhaust gases along the inner wall of the chamber. On the other hand, it is preferable to induce secondary air into the exhaust passage to promote oxidations of unburned compounds in the thermal reactor. In the illustrated embodiment, secondary air inducing pipe 20 is provided to communicate each port passage 4 to the atmosphere through a non-return valve such as a reed valve 21 and a filter 22. The exhaust passage from the exhaust valve to the thermal reactor has a volume within the range of one displacement volume of the engine to less than four times the displacement volume and has a cross-sectional area less than three times the opening area of the exhaust valve, whereby the pulsation effect of the exhaust gases passing through the exhaust passage may be effectively promoted for introducing the secondary air.

The secondary air introduction is caused by negative pressure waves of the pulsation which are reflected at the end opening into the thermal reactor. It has been confirmed that the negative pressure waves are generated after the mass of the exhaust gases have passed through the exhaust passage. Therefore, the mass of the secondary air is formed after the mass of the exhaust gases and both masses sequentially pass through the exhaust passage and enter into the thermal reactor. Since a multi-cylinder engine is designed to avoid the interference between the masses of the exhaust gases from every cylinder, the mass of the exhaust gases and the mass of the secondary air discharge from both exhaust pipes 5 and 6 are in different phase.

In other words, when the mass of the exhaust gases is ejected from one of the exhaust pipes, the mass of the secondary air is ejected from the other exhaust pipe. Both of these masses which are discharged from the exhaust passages collide with each other in the core shell 15. Therefore, the exhaust gas is mixed with the secondary air in the core shell.

Since the gas flow swirls in the core shell after the point A, a confluence of mixture of the exhaust gases and the secondary air flows in the core shell without stagnation as indicated by arrows in the figures, turning over on the spherical back side 15*a* of the reaction chamber, and flows out from the opening 19. The swirling and turning over the gas flow extend the residence time of the gases while maintaining high temperature, which enhances oxidation of the unburned constituents in the reaction chamber. In addition, because the mixture gas swirls regularly on almost the same locus, a stable high temperature spot or zone may be provided at the center of the swirl where unburned constituents are ignited. This high temperature spot is subject to move according to the operational condition of the engine, for instance, rotation speed, loading, etc., and if the high temperature spot moves out from the core shell, reactivity will be reduced.

According to the present invention, the outlet passage through the opening 19 is narrowed by the curved projected part 15*b* to regulate the swirling of gases and prevent the high temperature spot from moving out from the core shell. After oxidation of the unburned constituents has been efficiently carried out, the gases flow out from the opening 19 and turn over to the space 18 between the inner shell 13 and the core shell 15. Exhaust gases passing through the space serve as heat insulation means for maintaining the reaction chamber in the core shell at a high temperature. Thus, exhaust gases, after producing a good insulation effect on the reaction chamber flow out into the exhaust pipe 8.

Since the core shell is supported by the upper and lower projections 16 and 17 provided on the vertical line passing the center of gravity of the core shell and each projection has a relatively small supporting surface, the core shell may be expanded around the supporting points. Therefore, the core shell is not broken by thermal stress at a high temperature. In addition, since the core shell is not in contact with the exhaust pipes 5 and 6, heat of the core shell cannot conduct to the exhaust pipes. Therefore, it is further possible to maintain the core shell at a high temperature to promote the oxidation.

As seen from the above, in the present invention the exhaust gases from a pair of exhaust pipes collide and mix in the core shell with swirling without stagnation or decrease of the speed of the gas flow to enhance the oxidation. Thus, the present invention can provide an exhaust gas purification system which may reduce noxious compounds without decreasing the power of the engine. Also a stable purification efficiency can be maintained with variable operational conditions of the engine; furthermore, it is possible to manufacture a small reaction chamber with high reactivity.

What is claimed is:

1. Exhaust gas purification system for an internal combustion engine having at least two cylinders with corresponding ports and exhaust valves, comprising a pair of first exhaust pipes, each of said exhaust pipes communicating with a port passage from the exhaust valve of the engine, a thermal reactor communicating with said first exhaust pipes, a second exhaust pipe communicating said thermal reactor to atmosphere, insulation means for maintaining the exhaust gases at a high temperature, and means for introducing secondary air into said first exhaust pipes, said thermal reactor comprising an inner shell for defining a reaction chamber therein, an outer shell provided for covering said insulation means, a core shell supported in said inner shell spaced therefrom, and a space being provided between said inner shell and said core shell communicating with said second exhaust pipe, said core shell having an egg-shaped body portion, a spherical back side and one opening at a front end of said body portion opposite the back side, said opening being narrowed to prevent a high temperature zone of gases from moving out of said core shell, said first exhaust pipes having end portions being inserted into said core shell through said opening such that exhaust gases discharging from both said first exhaust pipes flow together to said back side with swirling and are turned over on said back side.

2. Exhaust gas purification system for an internal combustion engine having at least two cylinders, in accordance with claim 1, in which said end portions of said first exhaust pipes are so arranged that both axes of said end portions of said pipes cross in the core shell and the confluence of gas flows from both of said first exhaust pipes is reflected at a point on the inner wall of the core shell to the back side.

3. Exhaust gas purification system for an internal combustion engine having at least two cylinders, in accordance with claim 1, in which said end portions of said first exhaust pipes are so arranged that both axes of said end portions of said pipes cross at a point on the inner wall of the core shell and the confluence of gas flows from both of said first exhaust pipes is reflected at the point to the back side.

4. Exhaust gas purification system for internal combustion engine having at least two cylinders, in accordance with claim 1, in which said core shell is supported by upper and lower projections provided on a line passing through the center of gravity of the core shell.

5. The system as set forth in claim 1, wherein the exhaust passage from the exhaust valve to the thermal reactor has a volume within a range of one displacement volume of the engine to less than four times the displacement volume and has a cross-sectional area less than three times the opening area of the exhaust valves, whereby the puslation effect of the exhaust gases passing through the exhaust passage may be effectively promoted for introducing the secondary air.

6. The exhaust gas purification system as set forth in claim 1, wherein said front end comprises a curved projected part of said body portion depending toward said end portions of said first exhaust pipes which forms the narrowed opening.

7. Exhaust gas purification system for an internal combustion engine having at least four cylinders with corresponding ports and exhaust valves, comprising siamese port passages each communicating with two exhaust valves of the engine, a pair of first exhaust pipes, each of said exhaust pipes communicating with one of said siamese port passages, a thermal reactor communicating with said first exhaust pipes, a second exhaust pipe communicating said thermal reactor to atmosphere, insulation means for maintaining the exhaust gases at a high temperature, and means for introducing secondary air into said first exhaust pipes, said thermal reactor comprising an inner shell for defining a reaction chamber therein, an outer shell provided for covering said insulation means, a core shell supported in said inner shell spaced therefrom, and a space being provided between said inner shell and said core shell communicating with said second exhaust pipe, said core shell having an egg-shaped body portion, a spherical back side and one opening at a front end of said body portion opposite the back side, said opening being narrowed to prevent a high temperature zone of gases from moving out of the core shell, said first exhaust pipes having end portions being inserted into said core shell through said opening such that exhaust gases discharging from both said first exhaust pipes flow together to said back side with swirling and are turned over on said back side.

8. The exhaust gas purification system as set forth in claim 7, wherein said front end comprises a curved projected part of said body portion depending toward said end portions of said first exhaust pipes which forms the narrowed opening.

* * * * *